United States Patent [19]

Yonkers

[11] 4,364,190

[45] Dec. 21, 1982

[54] OUTER SOLE FOR ATHLETIC SHOE

[75] Inventor: Ronald C. Yonkers, Hampton, N.H.

[73] Assignee: BRS, Inc., Beaverton, Oreg.

[21] Appl. No.: 178,008

[22] Filed: Aug. 14, 1980

[51] Int. Cl.[3] ..... A43B 13/04; A43B 13/22; A43B 5/00

[52] U.S. Cl. ..... 36/32 R; 36/59 C; 36/114; D2/320

[58] Field of Search ..... 36/32 R, 30 R, 59 R, 36/59 A, 59 C, 67 R, 67 A, 128, 129, 114; D2/319-321

[56] References Cited

U.S. PATENT DOCUMENTS

| | | | |
|---|---|---|---|
| D. 120,317 | 4/1940 | Reeves . | |
| D. 133,176 | 7/1942 | Gregg . | |
| D. 226,884 | 5/1973 | Persson . | |
| D. 253,257 | 10/1979 | Pasquier . | |
| 3,507,059 | 4/1979 | Vietas . | |
| 4,045,888 | 9/1977 | Oxenberg . | |
| 4,130,947 | 12/1978 | Denu . | |
| 4,241,524 | 12/1980 | Sink | 36/32 R |

FOREIGN PATENT DOCUMENTS

| | | | |
|---|---|---|---|
| 234802 | 8/1961 | Australia | 36/59 C |
| 184847 | 2/1956 | Austria . | |
| 830912 | 2/1952 | Fed. Rep. of Germany | 36/128 |
| 1026200 | 3/1958 | Fed. Rep. of Germany | 36/32 R |
| 1093702 | 11/1960 | Fed. Rep. of Germany . | |
| 911058 | 2/1946 | France . | |
| 1338044 | 8/1963 | France . | |
| 2403037 | 4/1979 | France | 36/32 R |
| 19673 | of 1908 | United Kingdom | 36/128 |
| 137709 | 1/1920 | United Kingdom | 36/67 A |

*Primary Examiner*—James Kee Chi

*Attorney, Agent, or Firm*—Schuyler, Banner, Birch, McKie and Beckett

[57] ABSTRACT

An outer sole (16) for use with an athletic shoe (10) is disclosed. The outer sole (16) is comprised of a base member (18) from which three layers of projections extend. The layers of projections include a first plurality of horizontal bars (24) whose width varies in accordance with the load exerted on the bottom of the sole during normal running; supplemental and intermediate bars (26, 28) extending downwardly from the first set of bars (24); and pairs of ridges (30) extending down from each intermediate bar (28) adjacent the lateral edges of the intermediate bars (28).

35 Claims, 5 Drawing Figures

OUTER SOLE FOR ATHLETIC SHOE

TECHNICAL FIELD

This present invention relates to shoes, and in particular, to athletic shoes and their outer soles. The athletic shoe and outer sole of the present invention are particularly useful in athletic shoes wherein motion in a forward linear direction is important.

BACKGROUND OF THE INVENTION

Athletic shoes have been designed to the particular needs of the sport or use in which the shoe is to be used. Each portion of the prior art athletic shoes, i.e., the shoe upper and the various sole layers, have been constructed with the particular end use in mind. In the design and construction of prior art outer soles for athletic shoes, traction has been the primary factor given consideration. While traction is important, other performance factors can also be significantly affected by outersole design and such factors merit greater emphasis than has been accorded them by the prior art. Moreover since the outersole constitutes about one third of the total weight of the shoe, it is important to maximize its contribution.

One type of sole used in athletic shoes is illustrated in U.S. Pat. No. 4,130,947 issued to Francis Denu on Dec. 26, 1978. The sole disclosed in this patent utilizes a plurality of ribs which extend partially across the width of the sole. All of the ribs appear to be of equal width.

Another type of sole for use with athletic shoes is illustrated in U.S. Pat. No. 4,043,058 issued to Jeffery L. Hollester et al. on Aug. 23, 1977. In the '058 patent, an outer sole is disclosed which includes a plurality of polygon-shaped studs extending downwardly from the lower surface of the outer sole. The studs provide the shoe with good traction and additional cushioning.

SUMMARY OF THE INVENTION

The present invention is directed to an outer sole for an athletic shoe. The sole includes a base member formed of a resilient material. The base member has a heel section, an arch section, a forefoot section and a toe section. The base member also has an upper surface for attachment to a shoe and a lower surface which faces the ground. A plurality of bars extend downwardly from the lower surface of the base member and are disposed in a direction transverse to the lengthwise direction of the base member. The bars are spaced from one another in the lengthwise direction of the base member and are located along substantially the entire length of the base member. The width of the bars varies in proportion to the load which is exerted at particular locations on the sole during running whereby the bars are wider at the areas of greatest load and narrower at areas of less load.

In a preferred embodiment, a supplemental or intermediate bar extends downwardly from each of the first bars to form a layer of second thickness below the base member. Each of the supplemental or intermediate bars has a width equal to that of the bar from which it extends. The length of each of the supplemental and intermediate bars is also set in direct proportion to the load exerted at the particular location along the bottom of the sole. Also, the lateral location of the supplemental and intermediate bars is made in relation to the location of load areas on the sole.

In a preferred embodiment, a plurality of ridges extend downwardly from the intermediate bars in the heel and forefoot sections adjacent the perimeter thereof. The ridges have a lower surface for contacting the ground. The area of the lower surface of each ridge is proportional to the load exerted on the sole during running at the location of a respective ridge whereby the lower surface area is greater at areas of greater load and smaller at areas of less load.

The sole design attempts to maximize the factors of durability, stability, and flexibility while maintaining the lightest possible weight. This is accomplished by relating the structural design of the outer sole to a load analysis at the interface between the sole and ground during running. Durability is enhanced by the raised bar and ridge pattern which accommodates load distribution at all phases of ground contact. Since the bars are wider at the areas of greater load and narrower where the load is less, sole rubber is against the road in direct proportion to the intensity of the forces which produce sole wear. The sole is kept as light as possible because the width of both the bars and ridges is increased at high load/wear areas and reduced at low load/wear areas. Flexibility is enhanced by the disposition of the bars transverse to the lengthwise direction of the base member which permit flexing of the shoe in the lengthwise direction of the sole while resisting flexing in the lateral direction. The flexibility is further enhanced by reducing the width of the bars in low load/wear areas.

Both the bars and ridges contribute to the stability of the shoe utilizing a sole of the present invention. The raised ridges along the perimeter of the bars aids stability. The ridges increase the stability of the foot on both flat and uneven terrain as a result of influences that are both physical and biological. In ground contact, the ridges are forced upward into the shoe, physically causing a slight cupping action of the mid-sole which counters any tendency of the foot to roll. At the same time, the cupping action of the mid-sole may be consciously or subconsciously perceived by the runner. This "biofeedback" effect can aid the athlete in adapting to changing conditions in running surface and exerts a stabilizing influence. The torsional stability of the shoe is also enhanced by the bars extending tansversely of the sole. The bars, while permitting flexing of the sole along the length of the sole, resist flexing in a plane along the width of the sole.

The raised ridges also act as traction aids in changing direction, turning corners, etc., and increase durability as a result of their strategic placement in high wear areas. Thus, larger ridges are located at areas of greater sole wear and smaller ridges are located in lower load areas.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof and to the accompanying descriptive matter in which there is illustrated and described a preferred embodiment of the invention.

DETAILED DESCRIPTION OF THE INVENTION

Figure 1:
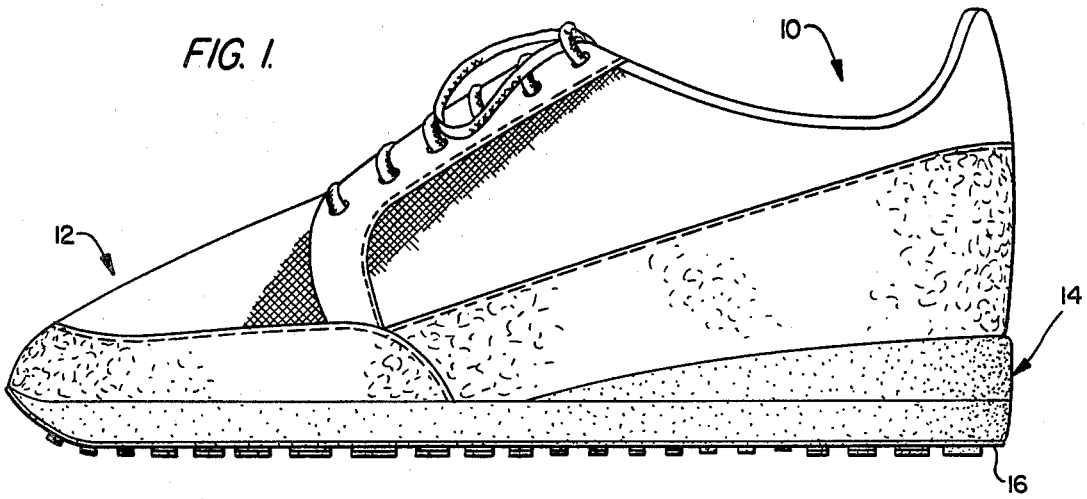
FIG. 1 is a side elevational view of an athletic shoe having an outer sole in accordance with the present invention.
Figure 2:
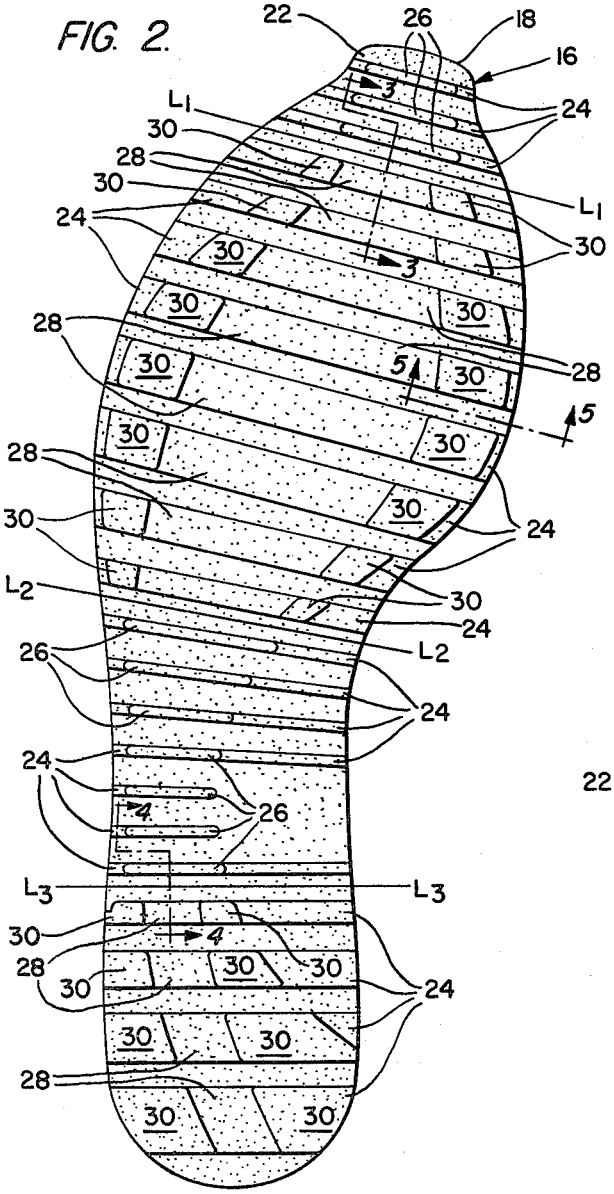
FIG. 2 is a bottom plan view of a sole in accordance with the present invention.
Figure 3:
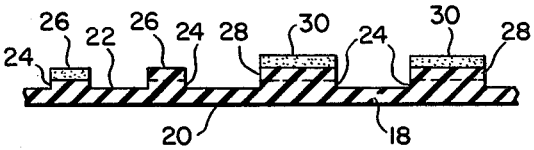
FIG. 3 is a sectional view taken generally along lines 3—3 of FIG. 2.
Figure 4:
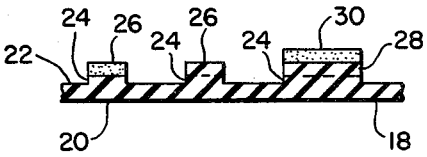
FIG. 4 is a sectional view taken generally along lines 4—4 of FIG. 2.
Figure 5:
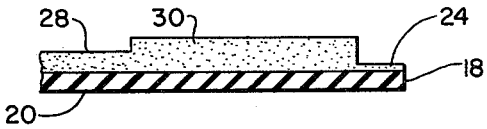
FIG. 5 is a sectional view taken generally along line 5—5 of FIG. 2.

Referring to the drawings in detail, wherein like the numerals indicate like elements, there is shown in FIG. 1 an athletic shoe in accordance with the present invention designated generally as 10. The shoe 10 includes a shoe upper 12 to which a multi-layered sole 14 is secured. The multi-layers sole 14 includes an outer sole 16, preferably made of a hard resilient and flexible wear-resistant material such as rubber or a comparable synthetic material. The entire outer sole 16, as seen in FIG. 2, is preferably made of a single integral piece of material.

The outer sole 16 has a base member 18 extending over the entire area of the outer sole 16. The base member 18 has an upper surface 20 which is attached to the next sole layer and a lower surface 22 which faces the ground. Three tiers or thicknesses of projections, which will be described in detail, extend integrally from the lower surface 22 of base member 18. The projections include a first set or plurality of bars 24, a plurality of supplemental bars 26, a plurality of intermediate bars 28, and a plurality of ridges or plugs 30.

The sole 16 and its base member 18 can be divided into four sections which relate to four areas of the foot. These sections also broadly define relative load areas on the sole which occur during normal running. Lines $L_1$, $L_2$, $L_3$, generally delineate the sections in FIG. 2. The area forward of line $L_1$ will be referred to as the toe section. The area between lines $L_1$ and $L_2$ will be referred to as the forefoot section. The area between lines $L_2$ and $L_3$ will be referred to as the arch section and the area rearward of Line $L_3$ will be referred to as the heel section. The lengthwise direction of the sole 16 extends between the toe and heel sections. The term load as it is used herein refers to the forces which act on the foot, and, therefore on the outer sole during running, and the resultant wear on the outer sole. These forces are created by the impact strike of the heel upon the ground and the subsequent weight transfer during the phases of gait.

The bars 24 extend downwardly from the lower surface 22 of base member 18 to form a first layer of projections of a first thickness. As seen in FIG. 2 substantially all (all but two) of the bars 24 extend across the entire width of the base member 18. The bars 24 extend transversely of the lengthwise direction of the base member 18, are spaced from one another, and are disposed substantially along the entire length of base member 18.

The width of the bars 24 varies in direct proportion to the load forces which are exerted on the sole 16 at various positions along the length of the sole 16 during normal running strides. This results in the pattern of bar widths seen in FIG. 2. The bars 24 are narrowest in the arch and toe sections where load is the least. Since the load in the heel and forefoot sections is greater than in the arch and toe sections, the bars 24 are wider in the heel and forefoot sections. Also, within the heel and forefoot sections, the width of the bars 24 is varied in accordance with the load patterns within these sections. In the heel section, the rearmost bar 24 is the widest and successive bars 24 progressively narrow. In the forefoot section, the widest bar 24 is located generally in the center of the forefoot section wherein the load is highest. In either lengthwise direction away from the widest bar 24 in the forefoot section, the bars 24 progressively narrow. By varying the width of the bars 24 in this manner, the greatest load forces exerted on the sole 16 are distributed over larger surface areas, while maintaining a flexible base member 16 to a minimal thickness. The use of the bars 24 of varying widths results in the added advantage of allowing greater flexibility in the normal bending direction of the sole, while providing additional rigidity or stability in the lateral direction.

The supplemental bars 26 extend downwardly from the bars 24 within the toe and arch sections. The intermediate bars 28 extend downwardly from the bars 24 in the forefoot and heel sections.

To further refine or enhance the stability/durability provided by the bars 24, the area of the supplemental bars 26 and the intermediate bars 28 is also varied in direct proportion to the load forces exerted upon the sole 16 during normal running strides. Each supplemental bar 26 and intermediate bar 28 has a width equal to the bar 24 from which it extends. The length of each of the supplemental and intermediate bars 26, 28 is also proportioned to the load pattern along the sole 16 at the respective lengthwise locations. The supplemental and intermediate bars 26, 28, at given lengthwise positions are located laterally at the area of highest load. The resultant pattern of supplemental and intermediate bars 26, 28 can be seen in FIG. 2. In the toe section, where the load upon the sole 16 is low, narrow supplemental bars 26 are located in the lateral direction generally centrally, and gradually increase in length from front to back. In the forefoot section, the intermediate bars 28 are still located generally medially. The length of the intermediate bars 28 in the forefoot section progressively increases from the most forward area until the area of maximum load within the forefoot section, i.e., generally in the center of the forefoot section, is reached. Thereafter, the length of the intermediate bars 28 gradually decreases until the length is the shortest adjacent the arch section.

In the arch section, the supplemental bars 26 are located laterally toward the outside of edge of the sole 16 to accommodate higher load in that area as compared to the inside edge in the arch section. The length of the supplemental bars 26 within the arch section also varies in proportion to the load exerted in this section. Thus, the supplemental bar 26 immediately adjacent the forefoot section is the longest. Proceeding rearward, the supplemental bars 26 gradually decrease in length until slightly beyond the center of the arch section; and thereafter again increase in length.

In the heel section, the longest intermediate bar 28 is the rearmost bar. The rearmost bar 28 in the heel section is co-extensive with the first bar 24 from which it extends. Proceeding forward from the rearmost intermediate bar 28, the length of the intermediate bars in the heel section gradually decreases. The decrease is accomplished by shortening the length of the intermediate bars on the inside edge while leaving the intermediate bars generally co-extensive with the first bars 24 on the outside edge.

A pair of the ridges 30 extends downwardly from each intermediate bar 28. Each ridge 30 of a given pair is spaced laterally from the other of the pair. Each ridge 30 is disposed adjacent a lateral edge of the intermediate bar 28 from which it extends. The outer perimeter of the ridges 30 thus follows the contour of the outer perimeter of the intermediate bars 28. Each ridge 30 has a lower ground contact surface whose area is the direct proportion to the load exerted at a given location on the outer sole 16. As seen in FIG. 2, the rearmost ridges in the heel section are the largest and gradually decrease in size proceeding in a forward direction. This is in proportion to the load forces on the heel section. In the forefoot section, the largest ridges 30 are disposed approximately in the center thereof and gradually decrease in size in either direction therefrom. As discussed above, the ridges 30 are proportioned in accordance with the load forces on the sole 16 during running, the ridges 30 serve as wear points at maximum load areas. Secondly, the ridges serve as traction aids. Thirdly, the ridges desirably perform a stabilizing function by causing a slight cupping of the mid-sole which may be perceived by the runner as the ground is contacted from heel stride to toe off.

In one embodiment of the sole 16, the following thicknesses of the various layers of the sole have been found suitable:

a base member 18 having a thickness of 0.063 inches;

a combined thickness of base member 18 and bar 24 being 0.100 inches;

a combined thickness of base member 18, bar 24 and supplemental bar 26 or intermediate bar 28 being 0.150 inches; and a combined thickness of base member 18, bar 24, intermediate bar 28 and ridge 30 being 0.200 inches.

The construction of outer sole 16 in the manner described above results in an outer sole which is especially suitable for athletic shoes wherein forward linear motion is of primary concern, however, the principles of this invention can be used in shoes wherein lateral motion occurs. The weight of the shoe is kept to a minimum. Also, flexibility of the sole in the direction of running is attained by disposing the bars transverse to the linear direction of the sole. By sizing the various layers of bars in accordance with the load forces presented to the sole during running, durability of the sole is enhanced while not adding to the weight in an unnecessary manner. Also, the use of the transverse bars results in increased torsional or lateral stability. The sole thus takes into account numerous design criteria which results in a lightweight and efficient sole. While the sole has been shown on a curved last-type sole, it should be understood that the features of sole 16 can be used on sole of straight last and other adductions i.e., curved lasts wherein the forefoot and toe sections are slanted at angles other than illustrated herein.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

I claim:

1. An outer sole for an athletic shoe comprising:

a base member formed of resilient material and having a heel section, an arch section, a forefoot section and a toe section, said base member having an upper surface for attachment to a shoe and a lower surface for facing the ground;

a plurality of bars extending downwardly from the lower surface of said base member and transverse to the lengthwise direction thereof, said bars being spaced from one another in the lengthwise direction of said base member, said bars having widths in the lengthwise direction of the outer sole which are varied in proportion to the load exerted at particular locations along the lengthwise direction of said outer sole during running, whereby said bars are wider at areas of greater load and are narrower at areas of less load; and an intermediate bar extending downward from a plurality of said bars in each of said forefoot and heel sections, the length of said intermediate bars in the transverse direction of the outer sole varying in proportion to the load exerted at particular locations along the lengthwise direction of said outer sole during running, whereby said intermediate bars are longer at areas of greater load and are shorter at areas of less load.

2. An outer sole in accordance with claim 1 including a supplemental bar extending downward from at least one of the bars in each of said toe and arch sections.

3. An outer sole in accordance with claim 1 including a supplemental bar extending downward from each of said bars in said toe and arch sections.

4. An outer sole in accordance with claim 2 wherein the length of said supplemental bars in the transverse direction of the outer sole is varied in proportion to the load exerted at particular locations along the lengthwise direction of said outer sole during running, whereby said supplemental bars are longer at areas of greater load and are shorter at areas of less load.

5. An outer sole in accordance with claim 4 wherein the lateral disposition of each of said supplemental bars is in the area of highest load on said outer sole during running at respective locations along the lengthwise direction of said base member.

6. An outer sole in accordance with claim 4 wherein the width of each of said supplemental bars is generally equal to the width of said bar from which it extends.

7. An outer sole in accordance with claim 1, 2, 3, 4 or 6 wherein the width of each of said intermediate bars is generally equal to the width of said bar from which it extends.

8. An outer sole in accordance with claim 7 wherein the lateral disposition of each of said intermediate bars is in the area of highest load on said outer sole during running at respective locations along the lengthwise direction of said base member.

9. An outer sole in accordance with claim 1, including a plurality of ridges extending downwardly from said intermediate bars in said heel and forefoot sections along the perimeter thereof, said ridges having a lower surface for contacting the ground, the area of the lower surface of each ridge being proportional to the load exerted on the sole during running at the location of a respective ridge, whereby the lower surface area is greater at areas of greater load and smaller at areas of less load.

10. An outer sole in accordance with claim 7, including a plurality of ridges extending downwardly from said intermediate bars in said heel and forefoot sections along the perimeter thereof, said ridges having a lower surface for contacting the ground, the area of the lower surface of each ridge being proportional to the load exerted on the sole during running at the location of a respective ridge, whereby the lower surface area is greater at areas of greater load and smaller at areas of less load.

11. An outer sole in accordance with claim 1, wherein each bar in said toe, forefoot and heel sections extends across the entire width of said base member.

12. An outer sole in accordance with claim 9, wherein said base member, said first bars, said supplemental bars, said intermediate bars, and said ridges are formed of a single integral piece of material.

13. An outer sole in accordance with claim 9 wherein the thickness of said base member is approximately 0.063 inches; the combined thickness of said base member and said first bars is approximately 0.100 inches; the combined thickness of said base member, said first bars and one of said supplemental and said intermediate bars is approximately 0.150 inches; and the combined thickness of said base member, said first bars, said intermediate bars and said ridges is approximately 0.200 inches.

14. An outer sole for an athletic shoe comprising;

a base member formed of resilient material and having a heel section, an arch section, a forefoot section and a toe section, said base member having an upper surface for attachment to a shoe and a lower surface for facing the ground;

a plurality of bars extending downward from the lower surface of said base member and transverse to the lengthwise direction thereof in at least said forefoot and heel section and an intermediate bar extending downward from a plurality of said bars;

said bars having widths in the lengthwise direction of the outer sole and said intermediate bars having lengths in the transverse direction of the outer sole varying in proportion to the load exerted at particular locations along the lengthwise direction of said outer sole during running, whereby said bars are wider and said intermediate bars are longer at areas of greater load, and said bars are narrower and said intermediate bars are shorter at areas of less load;

a plurality of first ridges extending downward from at least one of said intermediate bars in said heel section on opposite lateral sides thereof and each having a downwardly facing ground contact surface; and a plurality of second ridges extending downward from at least one of said intermediate bars in said forefoot section on opposite lateral sides thereof and each having a downwardly facing ground contact surface.

15. An outer sole in accordance with claim 14, wherein the first ridges extend from a plurality of the intermediate bars in said heel section and said second ridges extend from a plurality of the intermediate bars in said forefoot section.

16. An outer sole in accordance with claim 14, wherein said first ridges extend from each of the intermediate bars in said heel section and said second ridges extend from each of the intermediate bars in said forefoot section.

17. An outer sole in accordance with claim 14 or 15, wherein said bars include bars in said arch section and said toe section said bars in said arch and toe sections having a width less than said bars in said heel section and said forefoot section.

18. An outer sole in accordance with claim 17, wherein the rearmost of said bars in said heel section has the largest width of the bars in said heel section, and the width of the bars in said heel section progressively decrease in width from said rearmost bar.

19. An outer sole in accordance with claim 13, wherein the area of the ground contact surface of said first ridges on the intermediate bars which extend from the bars of larger width is greater than the area of the ground contact surface of the first ridges on the intermediate bars which extend from the bars of smaller width.

20. An outer sole in accordance with claim 14, wherein the area of the ground contact surface of said second ridges on the intermediate bars which extend from the bars of larger width is greater than the area of the ground contact surface of said second ridges on the intermediate bars which extend from the bars of smaller width.

21. An outer sole in accordance with claim 17, including supplemental bars extending downwardly from the bars in said arch and toe sections, the lateral dimension of each of said supplemental bars being less than the lateral dimension of the bar from which it extends.

22. An outer sole for an athletic shoe comprising;

a base member formed of resilient material and having a heel section, an arch section, a forefoot section and a toe section, said base member having an upper surface for attachment to a shoe and a lower surface for facing the ground;

a plurality of bars extending downward from the lower surface of said base member and being disposed transverse to the lengthwise direction of said base member, said bars being spaced from one another along the lengthwise direction of said base member and being located along substantially the entire lengthwise dimension of said base member, said bars having varying widths in the lengthwise direction of the outer sole proportioned according to the load exerted on the sole during running, whereby said bars are wider at areas of greater load and are narrower at areas of less load;

a plurality of supplemental bars extending downwardly from the bars in said toe and arch sections, the lengths of said supplemental bars in the transverse direction of the outer sole varying in proportion to the load exerted on the sole during running, whereby said supplemental bars are longer at areas of greater load and are shorter at areas of less load;

a plurality of intermediate bars extending from the bars of said forefoot and heel sections, the lengths of said intermediate bars in the transverse direction of the outer sole varying in proportion to the load exerted on the sole during running, whereby said intermediate bars are longer at areas of greater load and are shorter at areas of less load.

23. An outer sole in accordance with claim 22 including a pair of laterally spaced ridges extending from each of said intermediate bars, each ridge of a pair being located adjacent a lateral edge of said intermediate bar from which it extends, said ridges being sized in proportion to the load exerted on the sole during running.

24. An outer sole in accordance with claim 22 wherein each of said supplemental bars and each of said intermediate bars have widths substantially equal to the width of the respective bars from which they extend.

25. An outer sole for an athletic shoe comprising;

a base member formed of a resilient material and having a heel section, an arch section, a forefoot section and a toe section, said base member having an upper surface for attachment to a shoe and a lower surface facing the ground;

a plurality of bars extending downward from the lower surface of said base member and transverse to the lengthwise direction thereof, said bars being spaced from one another in the lengthwise direction of said base member, and being located along substantially the entire length thereof, said bars in said heel and forefoot sections being wider than the bars in said arch and toe sections, the width of the bars in said heel and forefoot sections varying in width, the widest of said bars in said heel section being the rearmost bar in said heel section and the width of the remaining bars in said heel section progressively decreasing in width therefrom, the widest of said bars in said forefoot section being located adjacent the central area in the lengthwise direction of said forefoot section and the width of the remaining bars in said forefoot section progressively decreasing in width to either side of the widest bar in said forefoot section;

a plurality of supplemental bars extending downwardly from the bars in said toe and arch sections, each of said supplemental bars having a width substantially equal to the bar from which it extends, the length of the supplemental bars in said toe section increasing in length from the forwardmost of said supplemental bars to the rearmost supplemental bar in said toe section, the widest of said supplemental bars in said arch section being adjacent the forefoot section and the remaining supplemental bars in said arch section progressively decreasing in length therefrom toward the central lengthwise area of said arch section and thereafter increasing in length toward the heel section;

a plurality of intermediate bars extending from the bars of said forefoot and heel sections, each of said intermediate bars having a width substantially equal to the width of the bar from which it extends, the length of said intermediate bars in said forefoot section being the widest at approximately the central lengthwise area of said forefoot section and progressively decreasing in length on either side thereof, the length of the intermediate bars in said heel section being greatest at the rearmost of said intermediate bars and progressively decreasing therefrom.

26. An outer sole in accordance with claim 25 including a pair of laterally spaced ridges extending from each of said intermediate bars, each ridge of a pair being located adjacent a lateral edge of one of said intermediate bars.

27. An outer sole in accordance with claim 26 wherein each of said ridges has a ground contact surface and the area of said ground contact surfaces is in proportion to the load on said outer sole during running at respective locations along the length of the outer sole.

28. An athletic shoe comprising;

a shoe upper;

a sole secured to said shoe upper;

said sole including an outer sole having a base member formed of resilient material, said base member having a heel section, an arch section, a forefoot section, a toe section and a lower surface for facing the ground;

a plurality of bars extending downward from the lower surface of said base member and transverse to the lengthwise direction thereof, said bars being spaced from one another in the lengthwise direction of said base member, said bars having widths in he lengthwise direction of the outer sole which are varied in proportion to the load exerted at particular locations along the lengthwise direction of said outer sole during running, whereby said bars are wider at areas of greater load and are narrower at areas of less load; and an intermediate bar extending downward from a plurality of said bars in each of said forefoot and heel section, the length of said intermediate bars in the transverse direction of the outer sole varying in proportion to the load exerted at particular locations along the lengthwise direction of said outer sole during running, whereby said intermediate bars are longer at areas of greater load and are shorter at areas of less load.

29. An athletic shoe in accordance with claim 28 including a pair of laterally spaced ridges extending downward from at least one of said intermediate bars in each of said heel and forefoot sections.

30. An anthletic shoe comprising;

a shoe upper;

a sole secured to said upper;

said sole including an outer sole having a base member formed of resilient material and having a heel section, an arch section, a forefoot section, a toe section, and a lower surface for facing the ground;

a plurality of bars extending downward from the lower surface of said base member and being disposed transverse to the lengthwise direction of said base member, said bars being spaced from one another along the lengthwise direction of said base member and being located along substantially the entire lengthwise dimension of said base member, the widths of said bars in the lengthwise direction of the outer sole varying in proportion to the load exerted on the sole during running, whereby said bars are wider at areas of greater load and are narrower of areas of less load;

a plurality of supplemental bars extending downwardly from the bars in said toe and arch sections, the lengths of said supplemental bars in the transverse direction of the outer sole varying in proportion to the load exerted on the sole during running, whereby said supplemental bars are longer in areas of greater load and are shorter in areas of less load;

a plurality of intermediate bars extending downwardly from the bars of said forefoot and heel sections, the lengths of said intermediate bars in the transverse direction of the outer sole varying in proportion to the load exerted on the sole during running, whereby said intermediate bars are longer in areas of greater load and are shorter in areas of less load.

31. An anthletic shoe in accordance with claim 30 including a pair of laterally spaced ridges extending downwardly from each of said intermediate bars, each ridge of a pair being located adjacent a lateral edge of one of said intermediate bars, said ridges being sized in proportion to the load exerted on the sole during running.

32. An athletic shoe in accordance with claim 30 wherein each of said supplemental bars and each of said intermediate bars have widths substantially equal to the width of the respective bars from which they extend.

33. An athletic shoe comprising;

a shoe upper;

a sole secured to said shoe upper;

said sole including an outer sole having a base member formed of a resilient material and having a heel section, an arch section, a forefoot section and a toe section, said base member having an upper surface for attachment to a shoe and a lower surface facing the ground;

a plurality of bars extending downward from the lower surface of said base member and transverse to the lengthwise direction thereof, said bars being spaced from one another in the lengthwise direction of said base member, and being located along substantially the entire length thereof, said bars in said heel and forefoot sections being wider than the bars in said arch and toe sections, the width of the bars in said heel and forefoot sections varying in width, the widest of said bars in said heel section being the rearmost bar in said heel section and the width of the remaining bars in said heel section progressively decreasing in width therefrom, the widest of said bars in said forefoot section being located adjacent the central area in the lengthwise direction of said forefoot section and the width of the remaining bars in said forefoot section progressively decreasing in width to either side of the widest bar in said forefoot section;

a plurality of supplemental bars extending downwardly from the bars in said toe and arch sections, each of said supplemental bars having a width substantially equal to the bar from which it extends, the length of the supplemental bars in said toe section increasing in length from the forwardmost of said supplemental bars to the rearmost supplemental bar in said toe section, the widest of said supplemental bars in said arch section being adjacent the forefoot section and the remaining supplemental bars in said arch section progressively decreasing in length therefrom toward the central lengthwise area of said arch section and thereafter increasing in length toward the heel section;

a plurality of intermediate bars extending from the bars of said forefoot and heel sections, each of said intermediate bars having a width substantially equal to the width of the bar from which it extends, the length of said intermediate bars in said forefoot section being the widest at approximately the central lengthwise area of said forefoot section and progressively decreasing in length on either side thereof, the length of the intermediate bars in said heel section being greatest at the rearmost of said intermediate bars and progressively decreasing therefrom.

34. An athletic shoe in accordance with claim 33 including a pair of laterally spaced ridges extending from each of said intermediate bars, each ridge of a pair being located adjacent a lateral edge of one of said intermediate bars.

35. An athletic shoe in accordance with claim 34 wherein each of said ridges has a ground contact surface and the area of said ground contact surfaces is in proportion to the load on said outer sole during running at respective locations along the length of the outer sole.

* * * * *

UNITED STATES PATENT AND TRADEMARK OFFICE

CERTIFICATE OF CORRECTION

PATENT NO. : 4,364,190

DATED : December 21, 1982

INVENTOR(S) : Ronald C. Yonkers

It is certified that error appears in the above—identified patent and that said Letters Patent is hereby corrected as shown below:

Col. 8, Claim 19, line 1, change "claim 13" to --claim 14--;

Col. 10, Claim 28, line 8, "he" should be changed to --the--; and

Col. 10, Claim 31, line 1, "anthletic" should be changed to --athletic--.

Signed and Sealed this

*Eighth* Day of *March 1983*

[SEAL]

*Attest:*

GERALD J. MOSSINGHOFF

*Attesting Officer*

*Commissioner of Patents and Trademarks*